US010753014B2

(12) United States Patent
Xia

(10) Patent No.: US 10,753,014 B2
(45) Date of Patent: Aug. 25, 2020

(54) HALF-SLIDE MATCHED DEVICE AND ITS APPLICATION OF ULTRA-SMOOTHLY RECONSTRUCTING YARN HAIRY STRUCTURE

(71) Applicants: Wuhan Textile University, Wuhan, Hubei (CN); Wenxiang Ye, Hubei (CN)

(72) Inventor: Zhigang Xia, Hubei (CN)

(73) Assignees: Wuhan Textile University, Wuhan, Hubei (CN); Wenxiang Ye, Wuhan, Hubei (CN)

( * ) Notice: Subject to any disclaimer, the term of this patent is extended or adjusted under 35 U.S.C. 154(b) by 71 days.

(21) Appl. No.: 16/169,285

(22) Filed: Oct. 24, 2018

(65) Prior Publication Data

US 2019/0055679 A1 Feb. 21, 2019

(30) Foreign Application Priority Data

Nov. 17, 2017 (CN) ..... 2017 1 1141654

(51) Int. Cl.

| | |
|---|---|
| ***D02J 3/12*** | (2006.01) |
| ***D02J 7/00*** | (2006.01) |
| ***D02G 1/02*** | (2006.01) |
| ***D02G 1/06*** | (2006.01) |
| ***D02J 1/18*** | (2006.01) |
| ***D01H 4/02*** | (2006.01) |
| ***D01H 1/115*** | (2006.01) |
| ***D02J 1/08*** | (2006.01) |

(52) U.S. Cl.

CPC ..... *D02J 3/12* (2013.01); *D01H 1/115* (2013.01); *D01H 4/02* (2013.01); *D02G 1/02* (2013.01);

(Continued)

(58) Field of Classification Search

CPC ..... D02J 1/08; D02J 1/14; D02J 3/12; D02J 7/00; D02J 1/12; D02J 3/00; D01H 4/02;

(Continued)

(56) References Cited

U.S. PATENT DOCUMENTS 2,664,010 A * 12/1953 Emerson ..... D01D 10/0481 68/5 D
3,237,269 A * 3/1966 Hawkins ..... D02J 1/08 28/272

(Continued)

FOREIGN PATENT DOCUMENTS

JP 11100745 A * 4/1999 ..... D02J 3/02

*Primary Examiner* — Amy Vanatta

(57) ABSTRACT

A half-slide matched device and its application for ultra-smoothly reconstructing yarn hairy structure belong to a textile processing field. According to the half-slide matched device of the present invention, a vortex device static part and a vortex device moving part are matched. In practice, multiple devices are connected in tandem. When yarn moves, the parts of half-slide matched device are closed, for efficiently constraining and utilizing the vortex airflow. A directional jet tube one-directionally stretches hairiness on yarn surface to avoid hairiness random dispersion and entanglement, remove yarn surface impurities. Tandem-connected devices repeatedly superimpose and strengthen the reconstructed ultra-smooth yarn structure. The half-slide matched device can be opened when the yarn breaks, which facilitates splicing and maintenance. The half-slide matched device has a reasonable structure and is very convenient for wide application.

3 Claims, 3 Drawing Sheets

(52) U.S. Cl.
CPC ..... *D02G 1/06* (2013.01); *D02J 1/08* (2013.01); *D02J 7/00* (2013.01)

(58) Field of Classification Search
CPC . D01H 1/115; D01H 4/08; D02G 1/06; D02G 1/02; D04B 27/00; D04B 15/00; D02H 3/00; D03D 47/30
USPC ..... 28/222, 219, 273, 272
See application file for complete search history.

(56) References Cited

U.S. PATENT DOCUMENTS 3,333,313 A * 8/1967 Gilmore ..... D02J 1/08 28/275
3,703,751 A * 11/1972 Bowen ..... D02G 1/16 28/273
3,802,036 A * 4/1974 Parks ..... D02G 1/161 28/272
3,863,309 A * 2/1975 Price ..... D02G 1/161 28/273
3,979,805 A * 9/1976 Hoffsommer ..... D02G 1/161 28/254
4,148,179 A * 4/1979 Becker ..... D02J 1/00 57/350
4,829,640 A * 5/1989 Greb ..... D02G 1/122 28/255
5,263,311 A * 11/1993 Feil ..... D02J 1/00 57/333
5,579,566 A * 12/1996 Burkhardt ..... D02G 1/122 28/254
2001/0000364 A1 * 4/2001 Entrekin ..... D06B 3/045 8/151.2

* cited by examiner

HALF-SLIDE MATCHED DEVICE AND ITS APPLICATION OF ULTRA-SMOOTHLY RECONSTRUCTING YARN HAIRY STRUCTURE

CROSS REFERENCE OF RELATED APPLICATION

The present invention claims priority under 35 U.S.C. 119(a-d) to CN 201711141654.6, filed Nov. 17, 2017.

BACKGROUND OF THE PRESENT INVENTION

Field of Invention

The present invention relates to a half-slide matched device and its application for ultra-smoothly reconstructing yarn hairy structure, belonging to a textile processing field.

Description of Related Arts

Hairiness is one of the important indicators for determining yarn qualities. The yarn hairiness not only affects the production efficiency of the weaving, knitting and other post-processes, but also affects the appearance quality of the final product. The high-speed shuttle-less looms and high-speed warp knitting machines are widely used today. Therefore, it is urgent and meaningful to reduce spun yarn hairiness and reconstruct the hairy staple yarn to create an ultra-smooth surface structure.

The staple fiber yarn mainly has nip-end spinning and open-end spinning, wherein the nip-end spinning is represented by ring spinning. The ring spun yarn hairiness is generated in the spinning process, and the mechanism is that after being protruded from the yarn body, the migrated fiber ends without nipping by the front roller nip are unable to enter or wrap onto yarn stem, being protruded from yarn body to cause hairiness. The open-end spinning is represented by rotor spinning, and the yarn forming mechanism comprises the rotor twisting the stale strand in free ends as the fibers adding layer by layer, resulting the surface layer structure of spun yarn is loose, and surface fiber ends are easily exposed to form the hairiness. The yarn hairiness grows in the winding process and the warping process. The fundamental reason is that: the hairy yarn usually has a loose structure, suffering severe frictions to unwrap surface fibers and pull yarn inner fiber ends out of yarn surface as the yarn passing through machine parts such as the yarn guiding parts and tension parts during the high-speed processes such as winding and warping. As a result, the hairiness increases sharply and the surface structure is seriously damaged. In order to reduce the yarn hairiness and achieve the weaving using smooth yarns, the textile enterprises generally employ the sizing of warp yarns to attach hairiness onto yarn surface, and simultaneously enhance yarn strength and the wear resistance. However, warping usually adopts yarn-sheet sizing, and the yarn-sheet sizing will adhere the yarn to each other, wherein wet and dry splits are required. Meanwhile, the yarn tears each other to destroy the surface sizing coating and produce secondary hairiness. Although single yarn sizing can solve the problems of sizing coating damage and secondary hairiness caused by yarn-sheet sizing, the problems of de-sizing and polluting the environment remain outstanding. It can be seen that the elimination of the yarn hairiness and the increase of yarn sheath structural density should be carried out before the sizing.

A large number of studies have been done by scholars at home and abroad for the ring spinning process. There are two commonly used methods. One is to optimize the conventional ring spinning process by ordinary ways. This method can only reduce the yarn hairiness to a certain extent, and the effect is limited. The other is to adopt a novel spinning technology or special eliminating device to eliminate hairiness, which can greatly reduce the hairiness of the ring spun yarn. The novel ring spinning technology or the special hairiness device is a hot spot in the research of ring spinning technology. Currently, the novel ring spinning technology is represented by compact spinning technology, such as U.S. Pat. No. 4,488,397 "Device for stretching, condensing and transporting a rove of fibers during a spinning operation" published on Dec. 18, 1984; U.S. Pat. No. 6,073,314 "Device for condensing a drafted fiber strand" published on Jun. 13, 2000; U.S. Pat. No. 6,082,089 "Arrangement for condensing a drafted Fiber strand" published on Jul. 4, 2000; U.S. Pat. No. 6,170,126B1 "Transport Belt for transporting a fiber strand to be condensed" published on Jan. 9, 2001; U.S. Pat. No. 6,263,656B1 "Arrangement and method for condensing a drafted fiber strand and method for making yarn thereform" published on Jul. 24, 2001; U.S. Pat. No. 6,272,834B1 "Apparatus for condensing a drafted strand" published on Aug. 14, 2001; and U.S. Pat. No. 6,237,317B1 "Condensing zone for a spinning machine" published on May 29, 2001. The key principle of the above-mentioned compact spinning technology patents is the condensing of fiber strand to eliminate ring spinning triangle, enhance the strand edge fiber control and finally reduce spun yarn hairiness. However, the elimination of the spinning triangle reduces the fiber migrations to form a yarn with insufficient inner fiber coherence during compact spinning, remaining some fiber ends being exposed to form yarn hairiness. Compact spun yarn hairiness is still sharply increased after being subjected to friction. In specialty, the pneumatic compact spinning only has a significant effect on reducing the hairiness of the high-count yarn, and has a poor effect of the hairiness reduction for the low count thick yarns.

Currently, the special hairiness reducing device is in the form of air jet, mounted between the front roller and the yarn guide hook, and the formed hairiness is attached to the surface of the yarn by the rotation of the air flow, such as U.S. Pat. No. 41,481,779 "method and apparatus yarn treatment" published on Apr. 10, 1979 and U.S. Pat. No. 5,263,311 "method and apparatus for modifying spun textile yarn" published on Aug. 22, 1989. The main difference between these studies is that the yarn surface fibers are subjected to different force directions due to the different air jetting device, resulting in different hairiness re-wrapping styles, thus providing different yarn hairiness eliminating effects. However, since these devices can only be used after the spun yarn strand passing through the twisting triangle zone (because the fibers in the twisting triangle are basically loose, and easily tangled and broken by the jet airflow blowing), yarn hairs are just loosely flattened and wrapped onto yarn stem, instead of embedding into yarn inner structure. Therefore, in post-processing (such as winding), the loosely flattened and wrapped hairiness is easy to be pulled out and re-exposed, failing to achieving the true eliminating of yarn hairiness.

To solve the problems such as damaging yarn surface structure, increasing yarn hairiness sharply, weakening yarn strength, desiring the expensive and pollutive sizing caused by high-speed winding process friction, it is possible to use singeing of yarn; however, the singeing of yarn leads to fiber material losses and wastes. With rising costs of fiber materials, manufacturers are not likely to adapt singeing. Winding process optimization can partly suppress yarn hairiness increase by grinding and waxing, but employing hairiness reducing devices during winding are considered effective methods to solve yarn hairiness problems. There are a lot of relevant patents for the effective methods; however they are with similar principles, wherein in a winding machine, a forward-moving yarn is just roughly treated by one-step false-twisting method or one-step vortex rotating method; in such a manner that yarn hairs can be partly reduced by re-winding them onto yarn surface. Representatively, European patent EP 0,866,014 A2, published Sep. 23, 1998, Auto Winder, discloses mechanical action of false-twisting disc during winding, which forces free protruding fiber ends to return to a yarn body along a twisting direction, so as to reduce the yarn hairiness. U.S. Pat. No. 6,374,588 B1, published Apr. 23, 2002, Hairiness controlling device and winder, discloses mechanical action of false-twisting disc during winding, which forces free protruding fiber ends to return to a yarn body along a twisting direction, so as to reduce the yarn hairiness. European patent EP 1,146,002 A2, published Oct. 17, 2001, Automatic winder and hairiness suppressing device, discloses using an air vortex tube, so as to generate rotary airflow to re-wrap hairiness onto yarn body to reduce hairiness. In principle, airflow alone is not able to provide a sufficient wrapping effect. European patent EP 1,013,803 A2, published Jun. 28, 2000, Hairiness suppressing device for automatic winder, also discloses using an air vortex tube, which rotates yarn with airflow. When the rotating yarn passes through a regulating plate, fibers wrap onto a yarn body, in order to reduce hairiness. Chinese patent ZL99127507.1, published Jul. 5, 2000, Hairiness suppressing device for automatic winder, also discloses using an air vortex tube, which rotates yarn with airflow. However, two controllers are provided at both ends of the device for ensuring yarn rotates along an axis thereof and causes a false-twisting effect, improving efficiency of reducing yarn hairiness. In addition, Chinese patent ZL 200710052991.8, published Jan. 23, 2008, Method to reduce yarn hairiness, discloses false-twisting ironing method, which attaches yarn and wraps yarn hairiness during winding; however a very small amount of the hairiness is involved into a yarn body, so as to reduce the yarn hairiness during winding and knitting. Above methods and devices for reducing yarn hairiness have common functions: only suppressing the amount increase of yarn hairs by flattening or re-wrapping them onto yarn stem via airflow or mechanical force. Practical applications show that the flattened or re-wrapped hairiness has three defects: firstly, the hairiness flattening or re-wrapping direction is opposite to the moving direction of yarn as it is winded to form a cone package, then the flattened or re-wrapped hairiness is directional to the moving of yarn as it is un-winded from the cone package during warping, weaving and weft-knitting process, in which the flattened or re-wrapped hairiness is extremely easy to be scraped or bounced out; secondly, throughout flattening or re-wrapping process, the yarn hairiness lacks of positive and effective nipping force to improve the surface structure compactness, leading to a loose flattened or wrapped structure which facilitates the hairiness reformation of yarn enduring friction or rubbing again; thirdly, yarn imperfections such as neps and thick places are largely increased due to the fiber concentrations when the hairiness roughly flattened or re-wrapped onto yarn stem.

It can be seen that conventional methods for the yarn hairiness control during processes such as winding, warping and knitting have common features that: when non-actively holding the end of the hairiness, the yarn is subjected to false twisting or air blowing, so as to wind and press the majority of the hairiness extending from the surface of the yarn to the yarn surface in a looser form, which cannot form a dense structural relationship between the hairiness fiber and the yarn body, and the hairiness is only reduced visually. In the form of untwisting-twisting, during attaching the hairiness, the local twist of the yarn is dynamically transferred and redistributed, leading to weak twisted part, which is easily stretched by the tension of the yarn and deteriorates the uniformity of the yarn stem. More importantly, in the subsequent process, as the yarn is rubbed by the machine parts, the fibers that are loosely winded and pressed to the surface of the yarn can easily protrude from the surface of the yarn to form hairiness. There is no substantial improvement for post-processing and the quality of the final product. Moreover, above conventional hairiness reduction devices are not able to solve the hairiness problem at a room temperature for spun yarn of highly resilient fibers (such as wool fibers) and high stiffness fibers (such as bast fibers).

To solve the problem, Chinese Patent ZL 201410204503.0, published May 15, 2014, Method for improving yarn surface structure with positively holding, discloses wrapping yarn surface hairiness tightly on a yarn stem by a negative pressure holding. It is proved by practice that the method is able to effectively improve the hair-wrapping tightness. However, technical problems are still not solved such as easy unwrapping of the hairiness wrapping as its direction opposite to the yarn moving direction, yarn imperfection formation due to the rough wrapping hairiness concentrations, surface mesh blockage by losing fragile fibers to weaken the hair holding-wrapping effect, speed and efficiency limitation of the mechanical part rotation. American U.S. Pat. No. 10,053,802 B2, "hairy yarn ultra-smooth warping method" published on Oct. 26, 2015, provides a method to perform an ultra-smooth treatment of hairy yarn during the warping process; Chinese patent ZL 201510700297.7 "Method and apparatus for producing ultra-smooth knitted fabric using hairy yarn" published on Aug. 21, 2018, provides a ultra-smooth processing method for hairy yarn during the weft knitting process; and Chinese patent ZL 201510700161.6 "method of directional stretching and synergistic wrapping of the softened yarn hairiness" published on Oct. 26, 2015 provides an uniform wrapping of directional stretching hairiness to avoid yarn defects caused by random hairiness wrappings, which can be widely used for the processes of spinning, winding, warping, knitting and the like. Above three documents can wrap the yarn hairiness quickly and efficiently to achieve ultra-smooth processing of the hairy yarn, but all the vortex wrapping devices involved in the three patents adopt an integral vortex tubular structure, wherein high-speed yarn surface floating hairs, neps etc. are easily detached and blocked in the yarn-inserting channel, resulting in a high frequency of yarn end-breakage. After end-breakage of yarn, splicing of yarn can only conducted by firstly passing the yarn ends using fine-wire-guider, and then connecting yarn two ends for twisting together. Thus, the yarn splicing is troublesome and low efficient, incurring inconvenient maintenance, and limitation of the wide industrial application promotion. To overcome this deficiency, in this case, the partial open type designed vortex chamber is used, disappointingly causing weak vortex wrapping forces to get a low hairiness wrapping tightness and efficiency; consequently, the partial open type designed vortex chamber is unable to achieve high-efficiency high-speed tight wrapping of yarn hairiness, just being used in equipment for low-speed ring spinning, low-speed rewinding. Furthermore, above vortex devices for wrapping hairiness only perform once wrapping of yarn hairiness, failing to provide secondary wrapping of some remaining hairs that are not fully wrapped by the first wrapping, wherein the smooth degree of the processed yarn needs to be further improved.

The vortex spinning machine uses vortex airflow to wrap staple fibers into a yarn, which is the most effective technology for producing ultra-smooth staple yarn. The technical equipment has high automation degree and high yarn-forming speed, wherein the yarn production speed is up to 500 m/min. The technical representatives are Switzerland Rieter's MJS type and Japan Murata MVS type vortex spinning machines. The principle of vortex spinning is: the vortex spinning machine consists of staple strand delivery tube, staple fiber flow guider, a vortex tube and a stationary spindle (also called a core tube). There are 3 or 4 tangential air inlets on the external tube, whose bottom end is connected with an air compressor. The air compressor continuously jets the compressed air into the vortex chamber of the vortex tube along the air inlet to generate the vortex airflow; the staple fiber sliver is fed into the drafting system of the vortex spinning machine through a sliver feeding roller, being drafted into a continuous staple strand; then the continuous staple fiber strand is fed into the vortex spinning machine along the staple strand delivery tube at a high speed; when the rotating airflow vortex reaches the stationary spindle, it converges with the continuous staple fiber strand to create a coherent fiber ring along the internal wall of the vortex tube, which stably surrounds the outer surface of the stationary spindle, and rotates at a high speed to wrap the fiber into a yarn. Since the vortex spun yarn is constructed by wrapped fibers, the yarn surface is smooth with tightly fiber wrappings. However, the vortex spun yarn inner fibers are lack of migrations, causing a weak yarn strength and wearing resistance. Therefore, the vortex spinning machine is mostly used for processing and producing yarns using viscose fibers which have large fiber coherence forces and enough softness; in contrary, the vortex spinning machine is not suitable to produce yarn of hard spun fibers such as high-rigidity bast fibers and high elastic curled wool fibers. Definitely, the vortex spinning machine lacks ability to produce high count yarns with high strength and surface smoothness. Therefore, It is a bottleneck problem in the yarn processing technology to be solved: how to optimize application of vortex spinning principle to perform an high-speed and high-efficiency production of high count ultra-smooth and strong yarns of hard spun fibers such as ramie and wool fibers.

SUMMARY OF THE PRESENT INVENTION

It is difficult for conventional vortex wrapping device to splice broken yarn; only a single vortex is formed for hairiness wrapping, which results in inconvenient maintenance and poor wrapping effect; the vortex spinning cannot synergistically achieve high-smooth and high-strong yarn structural formation using fibers; varieties of vortex spinning used fiber and produced yarn are limited. Accordingly, in order to overcome above defects, the present invention provides a half-slide matched device and its application for ultra-smoothly reconstructing yarn hairy structure.

A half-slide matched device for ultra-smoothly reconstructing yarn hairy structure is provided, comprising: a first sliding rod, a second sliding rod, a third sliding rod, a fixer, a connector, an air inlet tube, an air outlet tube, a vortex device static part and a vortex device moving part, wherein the vortex device static part and the vortex device moving part are matched; the vortex device static part comprises is a yarn guide tube right part, a stationary spindle right part and a vortex tube right part; the yarn guide tube right part and the stationary spindle right part are embedded in the vortex tube right part; the vortex device moving part comprises a yarn guide tube left part, a stationary spindle left part and a vortex tube left part; the yarn guide tube left part and the stationary spindle left part are embedded in the vortex tube left part; the vortex tube left part is engaged with the vortex tube right part to form a vortex tube which is cylindrical, and the yarn guide tube left part is engaged with the yarn guide tube right part to form a yarn guide tube which is cylindrical; a yarn inlet is provided along a central axis of the yarn guide tube; a half of the yarn inlet is located on an engaging surface of the yarn guide tube left part, and the other half is located on an engaging surface of the yarn guide tube right part; the yarn guide tube is located in a head end of the vortex tube; the stationary spindle left part is engaged with the stationary spindle right part to form a stationary spindle with a conical front end; a yarn outlet is provided along a central axis of the stationary spindle; a cross section of the yarn outlet is semicircular, and a longitudinal section of the yarn outlet has an inverted funnel shape with an gradient-increasing diameter along the front end to a rear end of the stationary spindle; a half of the yarn outlet is located on an engaging surface of the stationary spindle left part, and the other half is located on an engaging surface of the stationary spindle right part; the stationary spindle is located in a tail end of the vortex tube, and a vortex chamber is formed between the stationary spindle and the vortex tube; central axes of the vortex chamber, the yarn outlet and the yarn inlet coincide with each other; a dovetail groove is provided on the fixer along a length direction thereof, and the vortex tube right part is fixedly inserted into the dovetail groove of the fixer; the connector is provided with a dovetail groove along the length direction, and the vortex tube left part is fixedly inserted into the dovetail groove of the connector; an air inlet and an air outlet are provided on a wall of the vortex tube right part; an outlet opening of the air inlet corresponds to an inlet opening of the yarn outlet at the front end of the stationary spindle, and an inlet opening of the air inlet is fixedly connected to an end of the air inlet tube; an inlet opening of the air outlet corresponds to the rear end of the stationary spindle, and an outlet opening of the air outlet is connected to the air outlet tube; the first sliding rod, the second sliding rod and the third sliding rod are arranged on an engaging surface of the vortex tube right part; the first sliding rod, the second sliding rod and the third sliding rod are respectively perpendicular to the engaging surface of the vortex tube right part, and respectively located on one side of a central axis of the vortex tube right part; the first sliding rod and the third sliding rod are located at an upper portion of the vortex tube right part, and the second sliding rod is located at a lower portion of the vortex tube right part; an air inlet, a first connection hole, a second connection hole and a third connection hole are provided on a wall of the vortex tube left part; the air inlet on the wall of the vortex tube left part corresponds to the air inlet on the wall of the vortex tube right part, the first sliding rod is movably inserted in the first connection hole, the second sliding rod is movably inserted in the second connection hole, and the third slide rod is movably inserted in the third connection hole.

A method of applying the half-slide matched device for ultra-smoothly reconstructing yarn hairy structure on a textile machine is also provided, comprising steps of: at least fixedly engaging a vortex device static part of a first half-slide matched device with a vortex tube right part of a second half-slide matched device by a fixer, and fixedly engaging a vortex device moving part of the first half-slide matched device with a vortex tube left part of the second half-slide matched device by a connector; fixedly connecting the connector to an end of a push-pull rod, and externally connecting the other end of the push-pull rod to a pneumatic device; wherein each air outlet tube communicates with a directional air tube, and an end surface of an air outlet of the directional air tube is parallel to a central axis of a yarn inlet of a yarn guide tube; each air inlet tube is connected to an air compressor in parallel.

The textile machine is a ring spinning machine, a rotor spinning machine, a winder, a warping machine, a weft knitting machine, a warp knitting machine or an air jet loom.

Compared with prior art, due to the above technical solution, the half-slide matched device and its application for ultra-smoothly reconstructing yarn hairy structure have advantages as follows. The half-slide matched device of the present invention adopts a structural design of "symmetrically arranged vortex device static part and vortex device moving part". In practice, multiple devices are combined in series by "at least fixedly engaging a first half-slide matched device with a second half-slide matched device by a fixer". The vortex device static part and the vortex device moving part of the half-slide matched device are closed for efficiently constraining and utilizing the vortex airflow, thereby avoiding the technical problem of "partial open type device with low vortex utilization rate". Each closed vortex chamber is connected in parallel to the directional jet tube to one-directionally stretch hairiness on yarn surface to avoid random dispersion and entanglement, so as to remove impurities of the yarn surface. As a result, unfavorable factors such as "impurity and attached fibers accumulate within the conventional hairiness wrapping device and block the yarn passage, causing breakage, low efficiency, etc." are eliminated, improving application production efficiency and stability. The yarn is sequentially subjected to vortex in each closed vortex chamber, in such a manner that the hairiness on the surface of the hairy yarn is tightly wrapped by repeated superimposition and repeated reinforcement, which realizes the ultra-smooth processing of hairy yarn and breaks through the technical bottleneck that "the conventional device has only a single vortex for hairiness wrapping, wherein the high-efficiency high-speed tight wrapping of yarn hairiness is not achieved; the device can be just applied in equipment for low-speed ring spinning, low-speed rewinding". After ultra-smoothly reconstructing various yarn hairy surface structures, the corresponding fiber utilization rate of the tight hairiness-wrapped ultra-smooth yarn body is improved, and the yarn strength is enhanced, which solves the problem that "the vortex spinning cannot achieve the production of high count yarns with high strength and surface smoothness; and the used fibers and produced yarn varieties are very limited for vortex spinning due to its failure of producing yarn of hard spun fibers such as high-rigidity bast fibers and high elastic curled wool fibers". When the yarn breaks, the vortex device static part and the vortex device moving part of the half-slide matched device can be slide to open, which is convenient for yarn slicing and the device internal cleaning, so as to effectively solve the problem that "the conventional vortex wrapping device has difficulty of yarn slicing and the wide industrial application promotion". The half-slide matched device of the present invention has reasonable structure and simple installation on textile processing machines; the present invention, highlighted with wide adaptability and convenient operation, adopts several half-slide matched devices in tandem to improve tightness, efficiency and speed of various hairy yarn surface ultra-smooth reconstruction, so as to be suitable for wide application as it can treat various hairy yarn on different textile machines under various moisture regaining conditions.

DETAILED DESCRIPTION OF THE PREFERRED EMBODIMENT

Figure 1:
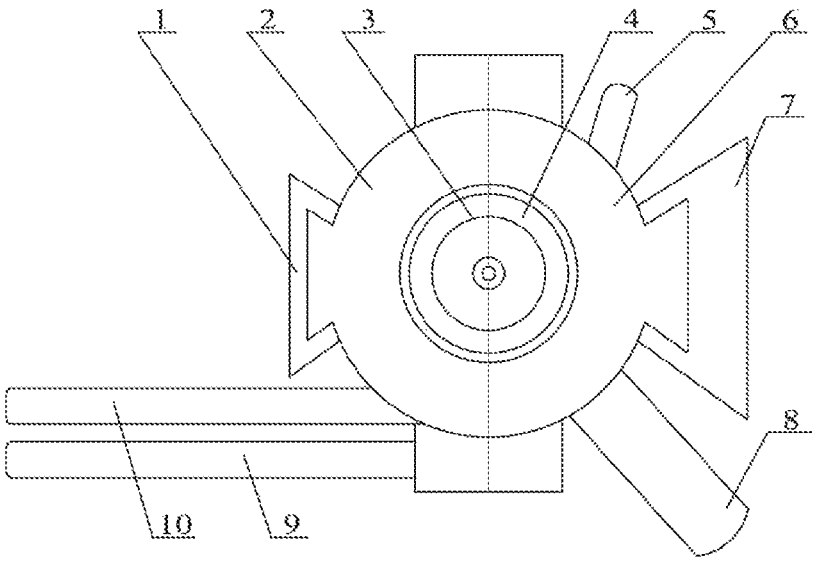
FIG. 1 is a structural view of a half-slide matched device of the present invention.
Figure 2:
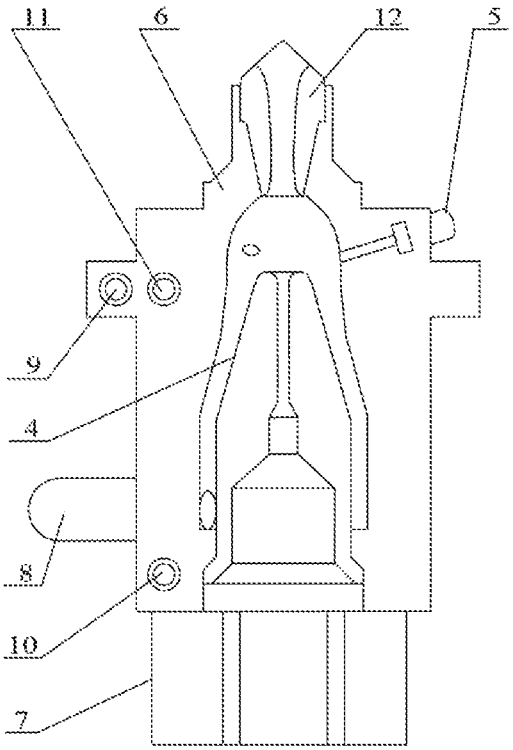
FIG. 2 is a structural view of a vortex device static part of the half-slide matched device of the present invention.
Figure 3:
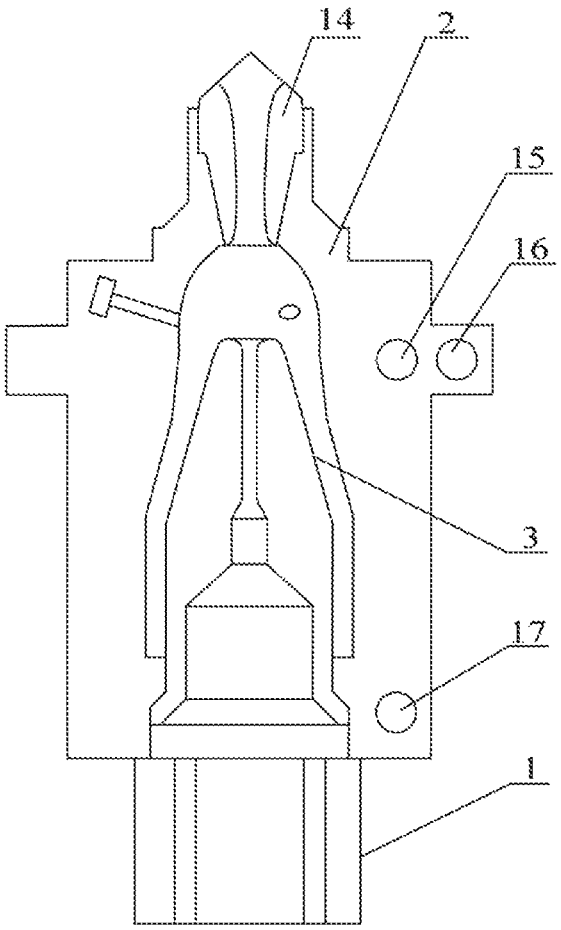
FIG. 3 is a structural view of a vortex device moving part of the half-slide matched device of the present invention.
Figure 4:
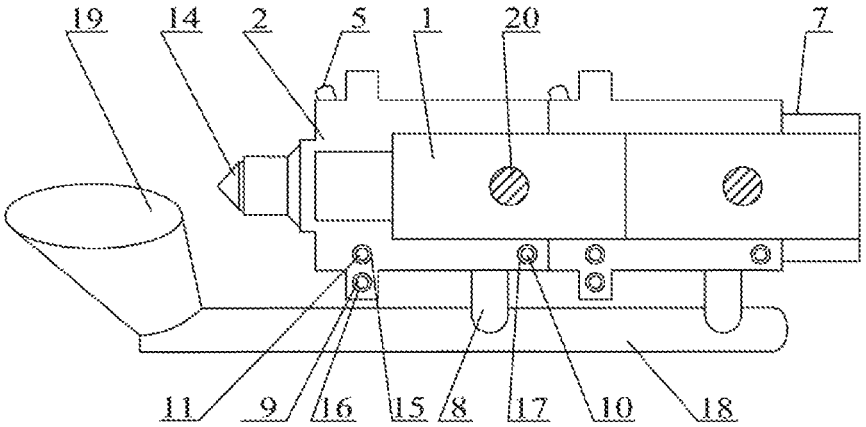
FIG. 4 is an assembly view of the half-slide matched device of the present invention.
Figure 5:
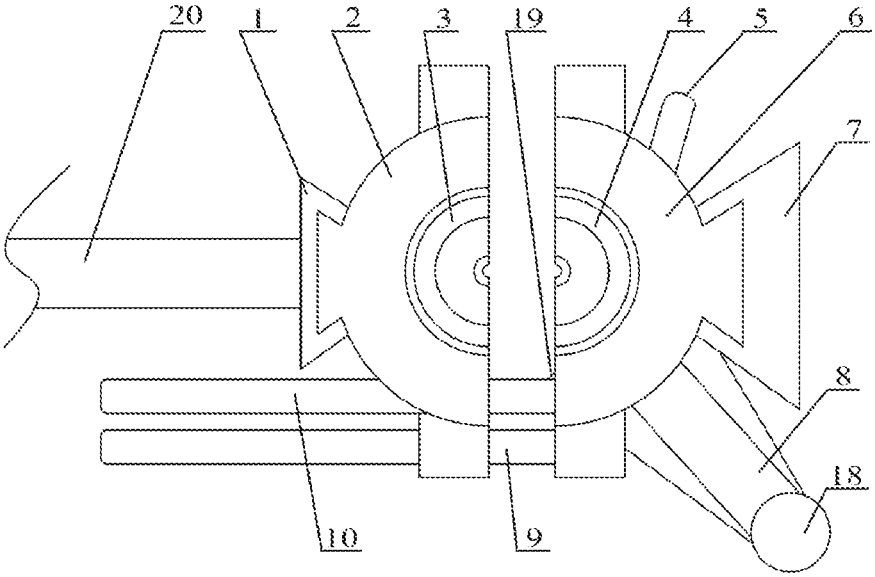
FIG. 5 is illustrates opening of the vortex device static part and vortex device moving part when yarn breaks.

Referring to the drawings, a half-slide matched device and its application for ultra-smoothly reconstructing yarn hairy structure of the present invention will be further illustrated.

Please refer to the drawings.

A half-slide matched device for ultra-smoothly reconstructing yarn hairy structure is provided, which comprises: a first sliding rod 9, a second sliding rod 10, a third sliding rod 11, a fixer 7, a connector 1, an air inlet tube 5, an air outlet tube 8, a vortex device static part and a vortex device moving part, wherein the vortex device static part and the vortex device moving part are matched; the vortex device static part comprises is a yarn guide tube right part 12, a stationary spindle right part 4 and a vortex tube right part 6; the yarn guide tube right part 12 and the stationary spindle right part 4 are embedded in the vortex tube right part 6; the vortex device moving part comprises a yarn guide tube left part 14, a stationary spindle left part 3 and a vortex tube left part 2; the yarn guide tube left part 14 and the stationary spindle left part 3 are embedded in the vortex tube left part 2; the vortex tube left part 2 is engaged with the vortex tube right part 6 to form a vortex tube which is cylindrical, and the yarn guide tube left part 14 is engaged with the yarn guide tube right part 12 to form a yarn guide tube which is cylindrical; a yarn inlet is provided along a central axis of the yarn guide tube; a half of the yarn inlet is located on an engaging surface of the yarn guide tube left part 14, and the other half is located on an engaging surface of the yarn guide tube right part 12; the yarn guide tube is located in a head end of the vortex tube; the stationary spindle left part 3 is engaged with the stationary spindle right part 4 to form a stationary spindle with a conical front end; a yarn outlet is provided along a central axis of the stationary spindle; a cross section of the yarn outlet is circular, and a longitudinal section of the yarn outlet has an inverted funnel shape with an gradient-increasing diameter along the front end to a rear end of the stationary spindle; a half of the yarn outlet is located on an engaging surface of the stationary spindle left part 3, and the other half is located on an engaging surface of the stationary spindle right part 4; the stationary spindle is located in a tail end of the vortex tube, and a vortex chamber is formed between the stationary spindle and the vortex tube; central axes of the vortex chamber, the yarn outlet and the yarn inlet coincide with each other; a dovetail groove is provided on the fixer 7 along a length direction thereof, and the vortex tube right part 6 is fixedly inserted into the dovetail groove of the fixer 7; the connector 1 is provided with a dovetail groove along the length direction, and the vortex tube left part 2 is fixedly inserted into the dovetail groove of the connector 1; an air inlet and an air outlet are provided on a wall of the vortex tube right part 6; an outlet opening of the air inlet corresponds to an inlet opening of the yarn outlet at the front end of the stationary spindle, and an inlet opening of the air inlet is fixedly connected to an end of the air inlet tube 5; an inlet opening of the air outlet corresponds to the rear end of the stationary spindle, and an outlet opening of the air outlet is connected to the air outlet tube 8, the first sliding rod 9, the second sliding rod 10 and the third sliding rod 11 are arranged on an engaging surface of the vortex tube right part 6; the first sliding rod 9, the second sliding rod 10 and the third sliding rod 11 are respectively perpendicular to the engaging surface of the vortex tube right part 6, and respectively located on one side of a central axis of the vortex tube right part 6; the first sliding rod 9 and the third sliding rod 11 are located at an upper portion of the vortex tube right part 6, and the second sliding rod 10 is located at a lower portion of the vortex tube right part 6; an air inlet, a first connection hole 16, a second connection hole 17 and a third connection hole 15 are provided on a wall of the vortex tube left part 2; the air inlet on the wall of the vortex tube left part 2 corresponds to the air inlet on the wall of the vortex tube right part 6, the first sliding rod 9 is movably inserted in the first connection hole 16, the second sliding rod 10 is movably inserted in the second connection hole 17, and the third slide rod 11 is movably inserted in the third connection hole 15.

A method of applying the half-slide matched device for ultra-smoothly reconstructing yarn hairy structure on a textile machine is provided, wherein the textile machine is a ring spinning frame, a rotor spinning machine, a winder, a warping machine, a weft knitting machine, a warp knitting machine or an air jet loom. The method comprises steps of: at least fixedly engaging a vortex device static part of a first half-slide matched device with a vortex tube right part 6 of a second half-slide matched device by a fixer 7, and fixedly engaging a vortex device moving part of the first half-slide matched device with a vortex tube left part 2 of the second half-slide matched device by a connector 1; fixedly connecting the connector 1 to an end of a push-pull rod 20, and externally connecting the other end of the push-pull rod 20 to a pneumatic device; wherein when the yarn breaks, the pneumatic device drives the push-pull rod 20 to move the vortex device moving part away from the vortex device static part, in such a manner that the vortex device static part and the vortex device moving part of the half-slide matched device are opened, which is convenient for broken yarn slicing and internal cleaning of the half-slide matched device, so as to effectively solve the problem that "the conventional vortex wrapping device has difficulty in yarn slicing and industrial promotion; fibers accumulated in conventional vortex wrapping device block the yarn passage, causing frequent breakage, low efficiency, etc."; when the yarn moves, the vortex device static part and the vortex device moving part of the half-slide matched device are closed by the push-pull rod 20 for efficiently constraining and utilizing the vortex airflow, thereby avoiding the technical problem of "partial open type device with low vortex utilization rate"; each air outlet tube 8 is connected to a directional air tube 18, and an end surface of an air outlet 19 of the directional air tube 18 is parallel to a central axis of a yarn inlet of a yarn guide tube; so as to one-directionally stretch hairiness on yarn surface to avoid random dispersion and entanglement, and to remove impurities and floating hairiness of the yarn surface; as a result, unfavorable factors such as "impurity and attached fibers accumulate within the conventional hairiness wrapping device and block the yarn passage, causing breakage, low efficiency, etc." are eliminated, improving application production efficiency and stability; each air inlet tube 5 is connected to an air compressor in parallel, in such a manner that high-pressure jet with a pressure of 4-8 MPa is injected into each vortex chamber, and the high-pressure jet is ordinary air or high-temperature hot wet steam with a temperature of 100-180° C.; higher fiber initial modulus of the yarn to be treated and higher vitrification or softening point temperature require higher the temperature of the hot wet steam for softened wrapping of the hairiness on the surface of the yarn and improving the wrapping effect; the high-pressure jet generates vortex in each vortex chamber, and the yarn is sequentially subjected to vortex in each closed vortex chamber, in such a manner that the hairiness on the surface of the hairy yarn is tightly wrapped by repeated superimposition and repeated reinforcement, which realizes the ultra-smooth processing of the yarn and breaks through the technical bottleneck that "the conventional device has only a single vortex for hairiness wrapping, wherein the high-efficiency high-speed tight wrapping of yarn hairiness is not achieved; the device can be just applied in equipment for low-speed ring spinning, low-speed rewinding"; After ultra-smoothly reconstructing various yarn hairy surface structures, the corresponding fiber utilization rate of the tight hairiness-wrapped ultra-smooth yarn body is improved, and the yarn strength is enhanced, which solves the problem that "the vortex spinning cannot achieve the production of high count yarns with high strength and surface smoothness; and the used fibers and produced yarn varieties are very limited for vortex spinning due to its failure of producing yarn of hard spun fibers such as high-rigidity bast fibers and high elastic curled wool fibers". The half-slide matched device of the present invention has reasonable structure and simple installation on textile processing machines; the present invention, highlighted with wide adaptability and convenient operation, adopts several half-slide matched devices in tandem to improve tightness, efficiency and speed of various hairy yarn surface ultra-smooth reconstruction, so as to be suitable for wide application as it can treat various hairy yarn on different textile machines under various moisture regaining conditions According to actual needs, the half-slide matched device can be converted to an integrated device.

The specific application of the present invention will be further illustrated below according to ultra-smoothly reconstructing of different hairy yarns on different textile machines.

Embodiment 1: Ultra-Smoothly Reconstructing Nm40 Pure Wool Yarn on a Ring Spinning Frame A mounting frame is arranged on the plane of the corresponding platform of each spindle of the wool spinning frame, and a guide crossbar is arranged in front of the mounting frame. The guide crossbar and the front roller grip line of the wool spinning frame are parallel to each other, and two half-slide matched devices are adopted in tandem. The series-connected half-slide matched devices are fixedly mounted behind the mounting frame, and the yarn inlet and the yarn outlet of the series-connected half-slide matched devices are perpendicular to the fixed yarn guide crossbar. The central axes of the yarn inlet and the yarn outlet are in the same plane with the front roller nip line of the spinning frame, and the plane is tangent to a top part of the guide crossbar. Each air inlet tube 5 of the series-connected half-slide matched devices is connected to the air compressor in parallel, so that the injection pressure jet in each vortex chamber is 5 MPa hot wet steam with a temperature of 100° C. Wool roving with a fixed weight of 6.25 g/10 m is drawn by 25 times into wool fiber strands by a drawing system of the wool spinning frame. The wool fiber strand is outputted from the front roller nip, and then immediately twisted into wool yarn under a torsion force by the ring twisting. The wool yarn moves above an air outlet end face of the directional jet tube 18, in such a manner that the hairiness of the yarn is one-directionally stretched, and the floating hairiness and impurities are removed. Then the yarn strand passes through the yarn inlet of the yarn guide tube formed by engaging the first half-slide matched device, and enter the vortex chamber of the first half-slide matched device. Subsequently, the yarn is outputted from the stationary spindle formed by engaging the first half-slide matched device, and passes through the yarn inlet of the yarn guide tube formed by engaged the second half-slide matched device, so as to enter the vortex chamber of the second half-slide matched device. Finally, the yarn is outputted from the stationary spindle formed by engaging the second half-slide matched device. The hairiness on the yarn surface is wrapped in the first vortex chamber, and partly unwrapped hairiness is then completely wrapped in the second vortex chamber. This combination of tandem-connected multiple devices is used to superimpose and repeatedly strengthen the ultra-smooth wrapping of the hairiness on the surface of the hairy yarn, so as to produce ultra-smooth reinforced wool yarn with the ring spinning frame. The wool yarn drawn from the yarn outlet passes through a top surface of the yarn guide crossbar, the yarn guide hook and the steel ring traveler, so as to be finally wound onto the bobbin. The results of the experimental spinnings with the same spindle, roving and spinning settings show that: the yarn smoothness is expressed in the textile field by the amount of hairiness on the surface of the yarn; less hairiness means higher smoothness; compared with the conventional ring spinning, 3 mm hairiness of the pneumatic compact spun wool yarn is decreased by 42.1%, 3 mm hairiness of the sirospun wool yarn is decreased by 52.7%, 3 mm hairiness of the soft and smooth spun wool yarn is decreased by 50.2%, 3 mm hairiness of the multiple mechanical condensed spun wool yarn is decreased by 39.0/o, and the hairiness of the yarn produced by the present invention is decreased by 91.7%; that is to say, the yarn hairiness is decreased drastically, the fiber utilization rate is effectively improved, and the increase of yarn strength is slightly higher than that of siro and pneumatic compact spinnings.

Embodiment 2: Ultra-Smoothly Reconstructing Nm32 Pure Ramie Yarn on a Winder A mounting frame is arranged between corresponding electronic yarn clearer and pre-clearer of each yarn passage of a Murata No. 21C automatic winder, and four half-slide matched devices are adopted in tandem. The tandem-connected half-slide matched devices are fixedly mounted on the mounting frame, and central axes of the yarn inlet and the yarn outlet of the series-connected half-slide matched devices coincide with central axes of yarn passages of the electronic yarn clearer and the pre-clearer. Each air inlet tube 5 of the tandem-connected half-slide matched devices is connected to the air compressor in parallel, so that the injection pressure jet in each vortex chamber is 7 MPa hot wet steam with a temperature of 180° C. The hairy pure ramie yarn is unwound from the bobbin at a speed of 1100 m/min, and passes through a yarn detector and the pre-clearing device to reach the tandem-connected half-slide matched devices in sequence. The ramie yarn moves above an air outlet end face of the directional jet tube 18, in such a manner that the hairiness of the yarn is one-directionally stretched, and the floating hairiness and impurities are removed. Then the yarn passes through the yarn inlet of the yarn guide tube formed by engaging the first half-slide matched device, and enters the vortex chamber of the first half-slide matched device. Subsequently, the yarn is outputted from the stationary spindle formed by engaging the first half-slide matched device, and passes through the yarn inlets, the vortex chambers, and the yarn outlets of the second half-slide matched device, the third half-slide matched device and the fourth half-slide matched device in sequence. The hairiness on the yarn surface is wrapped in the first vortex chamber by hot wet steam vortex, and partly unwrapped hairiness is then completely wrapped in the vortex chambers of the second half-slide matched device, the third half-slide matched device and the fourth half-slide matched device in a multiple progressive reinforcement form. This combination of tandem-connected multiple devices is used to superimpose and repeatedly strengthen the ultra-smooth wrapping of the hairiness on the surface of the hairy yarn, so as to provides ultra-smoothly reconstructing hairy yarn such as high-rigidity bast on the high-speed winder, which not only solves the technical problem of "the vortex spinning machine is not suitable to produce yarn of hard spun fibers such as high-rigidity bast fibers", but also completely eliminates the technical defect that high-speed winding causes the yarn hairiness to increase sharply. The yarn drawn from the yarn outlet of the fourth half-slide matched device sequentially passes through the electronic yarn clearer, the yarn guide plate and the winding drum, and is finally winded up to the cone package. The yarn smoothness is expressed in the textile field by the amount of hairiness on the surface of the yarn; less hairiness means higher smoothness. Experimental results show that: compared with the yarn after winding without the half-slide matched device of the present invention, the present invention ultra-smoothly reconstructed ramie yarn 3 mm hairiness is decreased by 82.9%, and the yarn strength is increased by 5.3%.

Embodiment 3: Ultra-Smoothly Reconstructing Ne30 Pure Cotton Yarn on a Rotor Spinning Machine A mounting frame is arranged between corresponding yarn guide tube outlet and yarn defect monitor of each rotor spinning device on a rotor spinning machine, and three half-slide matched devices are adopted in tandem. The tandem-connected half-slide matched devices are fixedly mounted on the mounting frame, and central axes of the yarn inlet and the yarn outlet of the tandem-connected half-slide matched devices coincide with a connecting line of yarn groove inlets of the corresponding yarn guide tube outlet and yarn defect monitor of each rotor spinning device. Each air inlet tube 5 of the tandem-connected half-slide matched devices is connected to the air compressor in parallel, so that the injection pressure jet in each vortex chamber is 6 MPa common compressed air flow, a cotton fiber sliver is fed into a rotor spinning device by the cotton feeding roller and the cotton feeding board; in the rotor spinning machine, a cotton fiber sliver is firstly carded into cotton strand by the carding roller; the cotton strand is delivered into a rotating rotor through a fiber conveyer tube; the cotton strand is twisted by the rotating rotor into a Ne 30 pure cotton yarn which is outputting from the rotor spinning device by a baffle plate. The pure cotton yarn has an inner tight and outside loose structure, meaning the yarn surface is insufficiently twisted to have lots of hairiness. Then the yarn with lots of hairiness is output from the corresponding yarn guide tube outlet of the rotor spinning machine at a speed of 200 m/min to reach the tandem-connected half-slide matched devices. The rotor spinning pure cotton yarn moves above an air outlet end face of the directional jet tube 18, in such a manner that the loosely flattened hairiness of the yarn is one-directionally stretched, and the floating hairiness is removed, thereby avoiding yarn defects such as hairiness random dispersion, neps caused by entanglement during hairiness wrapping. Then pure cotton yarn passes through the yarn inlet of the yarn guide tube formed by engaging the first half-slide matched device, and enters the vortex chamber of the first half-slide matched device. Subsequently, the yarn is outputted from the stationary spindle formed by engaging the first half-slide matched device, and passes through the yarn inlets, the vortex chambers, and the yarn outlets of the second half-slide matched device and the third half-slide matched device in sequence. The hairiness on the pure cotton yarn surface is wrapped in the first vortex chamber by air vortex, and partly unwrapped hairiness is then completely wrapped in the vortex chambers of the second half-slide matched device and the third half-slide matched device in a multiple progressive reinforcement form. This combination of tandem-connected multiple devices is used to superimpose and repeatedly strengthen the ultra-smoothly reconstructing the hairy yarn surface, so as to convert "rotor spinning yarn structure of tight inside and loose outside" into "ultra-smoothly reconstructed yarn structure with tight inside and tight outside" for the high-speed rotor spinning machine, which eliminates technical defects of loose surface and a lot of hairiness of the rotor spinning yarn in subsequent utilization, and low fiber utilization as well as low strength. The yarn drawn from the yarn outlet of the third half-slide matched device sequentially passes through the yarn defect monitor, the yarn feeding roller grip, the yarn guide, the winding roller, and is finally winded up to the cone. The half-slide matched device of the present invention can also be integrated, wherein the yarn inlet port of the half-slide matched device is designed to have a baffle-like shape, and the integrated half-slide matched device directly replaces the baffle plate of the conventional rotor spinning device. The yarn smoothness is expressed in the textile field by the amount of hairiness on the surface of the yarn; less hairiness means higher smoothness. Experimental results show that: compared with the rotor spinning yarn without the half-slide matched device of the present invention, the present invention ultra-smoothly reconstructed cotton yarn 3 mm hairiness is decreased by 80.7%, and the yarn strength is increased by 6.4%.

Embodiment 4: Ultra-Smoothly Reconstructing Ne60 Cotton/Modal 50/50 Yarn on a Weft Knitting Machine A mounting frame is arranged between corresponding yarn feeder and yarn guider of each yarn weft knitting mechanism on a weft knitting machine, and two half-slide matched devices are adopted in tandem. The tandem-connected half-slide matched devices are fixedly mounted on the mounting frame by a fixer 7 in a screw and screw cap form, and are located between the yarn feeder and the yarn guider. The central axes of the yarn inlet and the yarn outlet of the tandem-connected half-slide matched devices coincide with yarn between the yarn feeder and the yarn guider. After the tandem-connected half-slide matched devices are fixedly mounted on the mounting frame, each air inlet tube 5 of the tandem-connected half-slide matched devices is connected to the air compressor in parallel, so that the injection pressure jet in each vortex chamber is 4 MPa hot wet steam with a temperature of 125° C. The hairy cotton/modal yarn is unwound from the package located on the yarn package creel at a speed of 12 m/min, and passes through a tension device and the yarn feeder to enter the series-connected half-slide matched devices. The cotton/modal yarn moves above an air outlet end face of the directional jet tube 18, in such a manner that the hairiness of the yarn is one-directionally stretched, and the floating hairiness is removed, thereby avoiding yarn defects such as hairiness random dispersion, neps caused by entanglement during hairiness wrapping, and effectively removing yarn surface impurities as well as attaching fiber. Then the yarn passes through the yarn inlet of the yarn guide tube formed by engaging the first half-slide matched device, and enter the vortex chamber of the first half-slide matched device. Subsequently, the yarn is outputted from the stationary spindle formed by engaging the first half-slide matched device, and passes through the yarn inlet, the vortex chamber, and the yarn outlet of the second half-slide matched device. The hairiness is wrapped in the first vortex chamber by hot wet steam vortex, and unwrapped hairiness is then completely wrapped in the vortex chamber of the second half-slide matched device in a progressive reinforcement form. This combination of series-connected multiple devices is used to superimpose and repeatedly strengthen the reconstructed ultra-smooth yarn structure, so as to provides ultra-smoothly reconstructing of hairy yarn such as high-rigidity regenerated cellulose on the weft knitting machine. The ultra-smoothly reconstructed yarn drawn from the yarn outlet of the second half-slide matched device is guided by the yarn guider into a knitting zone of a knitting device. Under the action of the looping mechanism in the knitting zone, the knitted fabric is knitted and is outputted from the knitting zone by a pulling and unwinding mechanism. Surface smoothness of the fabric is usually expressed by observing the surface hairiness and testing abrasion resistance. Less surface hairiness and higher wear resistance of the fabric indicate higher smoothness of the fabric. The comparative trial results show that compared with the conventional weft knitting cotton/modal yarn fabric, the ultra-smoothly reconstructed cotton/modal yarn produced by the present invention has a smooth appearance, an increased bursting strength of the fabric with increased ratio of 3.4%, and an improved wear resistance of the fabric with improvement by 3 levels.

Embodiment 5: Ultra-Smoothly Reconstructing Ne60 100% TENBRO Yarn on a Warp Knitting Machine Two half-slide matched devices are adopted in tandem on a warp knitting machine. The tandem-connected half-slide matched devices are fixedly mounted on a yarn guider creel of a warp feeding mechanism on the warp knitting machine by a fixer 7 in a screw and screw cap form, and are located between the positive warp feeding mechanism and a yarn hook of loop mechanism. The central axes of the yarn inlet and the yarn outlet of the tandem-connected half-slide matched devices coincide with a yarn path between the positive warp feeding mechanism and the yarn hook of loop mechanism. After the tandem-connected half-slide matched devices are fixedly mounted on the yarn guide frame, each air inlet tube 5 of the tandem-connected half-slide matched devices is connected to the air compressor in parallel, so that the injection pressure jet in each vortex chamber is 5.5 MPa hot wet steam with a temperature of 150° C. The hairy TENBRO yarn is unwound from a warp beam on a warp beam creel at a speed of 30 m/min, and passes through a tension device and the positive warp feeding mechanism to reach the tandem-connected half-slide matched devices. The TENBRO yarn moves above an air outlet end face of the directional jet tube 18, in such a manner that the hairiness of the yarn is one-directionally stretched, and the floating hairiness as well as impurities are removed. Then the yarn passes through the yarn inlet of the yarn guide tube formed by engaging the first half-slide matched device, and enter the vortex chamber of the first half-slide matched device. Subsequently, the yarn is outputted from the stationary spindle formed by engaging the first half-slide matched device, and passes through the yarn inlet, the vortex chamber, and the yarn outlet of the second half-slide matched device. The hairiness is wrapped in the first vortex chamber by hot wet steam vortex, and unwrapped hairiness is then completely wrapped in the vortex chamber of the second half-slide matched device in a progressive reinforcement form. This combination of tandem-connected multiple devices is used to superimpose and repeatedly strengthen the reconstructed ultra-smooth yarn surface structure, so as to provide ultra-smoothly reconstructing of hairy yarn such as high-rigidity regenerated cellulose on the warp knitting machine, and breaking the technical bottleneck that hairy spun yarn cannot be knitted with a high speed on the warp knitting machine. The ultra-smoothly reconstructed yarn drawn from the yarn outlet of the second half-slide matched device is guided into the looping mechanism on the warp knitting machine by the yarn feeding hook of the looping mechanism for being knitted. Surface smoothness of the fabric is usually expressed by observing the surface hairiness and testing abrasion resistance. Higher wear resistance the fabric means higher smoothness of the fabric. The comparative trial results show that: assisted with the present invention, the hairy TENBRO yarn can be successfully knitted; compared with the trial jog warp knitted fabric using ordinary hairy TENBRO yarn, the surface hairiness of the fabric knitted by the present invention reconstructed ultra-smooth yarn is reduced by 67.2%, a bursting strength of the present invention knitted fabric is increased by 2.1%, and the wear resistance of the present invention knitted fabric is increased by 2.5 levels.

Embodiment 6: Ultra-Smoothly Reconstructing Nm40 Pure Ramie on a Warping Machine On each yarn warping mechanism of the warping machine, four half-slide matched devices are adopted in tandem. The tandem-connected half-slide matched devices are fixedly mounted on a row of yarn guide rod at each yarn output end of a warping machine creel by a fixer 7 in a screw and screw cap form, and are located between the yarn guide rod and an expansible reed. Central axes of the yarn inlet and the yarn outlet of the tandem-connected half-slide matched devices coincide with the yarn between the yarn guide rod and the expansible reed. After the tandem-connected half-slide matched devices are fixedly mounted on yarn guide rod, each air inlet tube 5 of the tandem-connected half-slide matched devices is connected to the air compressor in parallel, so that the injection pressure jet in each vortex chamber is 7 MPa hot wet steam with a temperature of 180° C. The hairy pure ramie weft yarn is unwound from the yarn package on the creel at a speed of 800 m/min, and passes through a tension device and the yarn guide rod in a tension state to reach the tandem-connected half-slide matched devices. The ramie weft yarn moves above an air outlet end face of the directional jet tube 18, in such a manner that the yarn hairiness is one-directionally stretched, and the floating hairiness as well as impurities are removed. Then the yarn passes through the yarn inlet of the yarn guide tube formed by engaging the first half-slide matched device, and enters the vortex chamber of the first half-slide matched device. Subsequently, the yarn is outputted from the stationary spindle formed by engaging the first half-slide matched device, and passes through the yarn inlets, the vortex chambers, and the yarn outlets of the second half-slide matched device, the third half-slide matched device and the fourth half-slide matched device in sequence. The hairiness on the surface of the yarn strip is wrapped in the first vortex chamber by hot wet steam vortex, and unwrapped hairiness is then completely wrapped in the vortex chambers of the second half-slide matched device, the third half-slide matched device and the fourth half-slide matched device in a multiple progressive reinforcement form. This combination of tandem-connected multiple devices is used to superimpose and repeatedly strengthen reconstructed ultra-smooth yarn surface structure, so as to provide ultra-smoothly reconstructing of hairy yarn such as high-rigidity ramie on the high-speed warping machine, which not only solves the technical problem of "vortex spinning fails to produce yarn of hard spun fibers such as high-rigidity bast fibers", but also completely eliminates the technical defect that high-speed warping causes the sharp increase of yarn hairiness. The yarn drawn from the yarn outlet of the fourth half-slide matched device sequentially passes through the expansible reed and a yarn guide roller, and is finally winded up to a warping beam. The yarn smoothness is expressed in the textile field by the amount of hairiness on the surface of the yarn; less hairiness means higher smoothness. The comparative trial results show that: the hairiness and strength of the present invention reconstructed Nm40 pure ramie yarn are greatly improved, wherein the 3 mm hairiness is reduced from 403.40 to 67.20, and the yarn strength is increased from 513.66 cN to 591.22 cN, wherein the yarn evenness index remains at the same level.

Embodiment 7: Ultra-Smoothly Reconstructing Nm38 Pure Wool Yarn on Air Jet Loom A mounting frame is arranged between corresponding creel and weft feeder of each weft insertion mechanism on an air jet loom, and two half-slide matched devices are adopted in tandem. The tandem-connected half-slide matched devices are fixedly mounted on the mounting frame by a fixer 7 in a screw and screw cap form, and are located between the creel and the weft feeder. The central axes of the yarn inlet and the yarn outlet of the tandem-connected half-slide matched devices coincide with yarn between the yarn feeding mechanism and the yarn guider. After the tandem-connected half-slide matched devices are fixedly mounted on the mounting frame, each air inlet tube 5 of the tandem-connected half-slide matched devices is connected to the air compressor in parallel, so that the injection pressure jet in each vortex chamber is 7 MPa hot wet steam with a temperature of 120° C. The hairy pure wool yarn is unwound from the yarn package on the creel at a speed of 800 m/min, and passes through a tension device to reach the tandem-connected half-slide matched devices. The pure wool yarn moves above an air outlet end face of the directional jet tube 18, in such a manner that the hairiness of the yarn is one-directionally stretched, and the floating hairiness as well as impurities are removed, thereby avoiding yarn defects such as hairiness random dispersion, neps caused by vortex wrapping of entangled hairiness, and improving application productivity and stability. Then the yarn passes through the yarn inlet of the yarn guide tube formed by engaging the first half-slide matched device, and enters the vortex chamber of the first half-slide matched device. Subsequently, the yarn is outputted from the stationary spindle formed by engaging the first half-slide matched device, and passes through the yarn inlet, the vortex chamber, and the yarn outlet of the second half-slide matched device. The hairiness of the pure wool yarn is wrapped in the first vortex chamber by hot wet steam vortex, and unwrapped hairiness is then completely wrapped in the vortex chamber of the second half-slide matched device in a progressive reinforcement form. This combination of tandem-connected multiple devices is used to superimpose and repeatedly strengthen reconstructed ultra-smooth yarn surface structure, so as to ensure the technical effect for ultra-smoothly reconstructing of hairy wool weft yarn and producing of smooth fabric on high-speed air jet loom. The yarn drawn from the yarn outlet of the second half-slide matched device is winded on the weft feeder, and the weft yarn unwound from the weft feeder is guided into the weaving mouth after passing through the main nozzle, the weft cutter, the weft detector and the auxiliary nozzle in sequence, so as to be woven into the fabric under the action of the steel reed beating, thus forming a woven fabric with a smooth surface. Surface smoothness of the fabric is usually expressed by observing the surface hairiness and testing abrasion resistance. Less surface hairiness and higher wear resistance indicate higher smoothness of the fabric. Compared with conventional wool woven fabric, the weft insertion rate for the weaving assisted by the present invention is increased by 25.2%, the surface hairiness of the woven fabric produced by the present invention is reduced by 62.1%, the smoothness is remarkably improved, the fabric wear resistance after rinsing and drying is improved by two levels, and fabric weft tensile strength is increased by 5.7%.

What is claimed is:

1. A half-slide matched device for ultra-smoothly reconstructing yarn hairy structure, comprising: a first sliding rod (9), a second sliding rod (10), a third sliding rod (11), a fixer (7), a connector (1), an air inlet tube (5), an air outlet tube (8), a vortex device static part and a vortex device moving part, wherein the vortex device static part and the vortex device moving part are matched; the vortex device static part comprises a yarn guide tube right part (12), a stationary spindle right part (4) and a vortex tube right part (6); the yarn guide tube right part (12) and the stationary spindle right part (4) are embedded in the vortex tube right part (6); the vortex device moving part comprises a yarn guide tube left part (14), a stationary spindle left part (3) and a vortex tube left part (2); the yarn guide tube left part (14) and the stationary spindle left part (3) are embedded in the vortex tube left part (2); the vortex tube left part (2) is engaged with the vortex tube right part (6) to form a vortex tube which is cylindrical, and the yarn guide tube left part (14) is engaged with the yarn guide tube right part (12) to form a yarn guide tube which is cylindrical; a yarn inlet is provided along a central axis of the yarn guide tube; a half of the yarn inlet is located on an engaging surface of the yarn guide tube left part (14), and the other half is located on an engaging surface of the yarn guide tube right part (12); the yarn guide tube is located in a head end of the vortex tube; the stationary spindle left part (3) is engaged with the stationary spindle right part (4) to form a stationary spindle with a conical front end; a yarn outlet is provided along a central axis of the stationary spindle; a cross section of the yarn outlet is circular, and a longitudinal section of the yarn outlet has an inverted funnel shape with an gradient-increasing diameter along the front end to a rear end of the stationary spindle; a half of the yarn outlet is located on an engaging surface of the stationary spindle left part (3), and the other half is located on an engaging surface of the stationary spindle right part (4); the stationary spindle is located in a tail end of the vortex tube, and a vortex chamber is formed between the stationary spindle and the vortex tube; central axes of the vortex chamber, the yarn outlet and the yarn inlet coincide with each other; a dovetail groove is provided on the fixer (7) along a length direction thereof, and the vortex tube right part (6) is fixedly inserted into the dovetail groove of the fixer (7); the connector (1) is provided with a dovetail groove along the length direction, and the vortex tube left part (2) is fixedly inserted into the dovetail groove of the connector (1); an air inlet and an air outlet are provided on a wall of the vortex tube right part (6); an outlet opening of the air inlet corresponds to an inlet opening of the yarn outlet at the front end of the stationary spindle, and an inlet opening of the air inlet is fixedly connected to an end of the air inlet tube (5); an inlet opening of the air outlet corresponds to the rear end of the stationary spindle, and an outlet opening of the air outlet is connected to the air outlet tube (8); the first sliding rod (9), the second sliding rod (10) and the third sliding rod (11) are arranged on an engaging surface of the vortex tube right part (6); the first sliding rod (9), the second sliding rod (10) and the third sliding rod (11) are respectively perpendicular to the engaging surface of the vortex tube right part (6), and respectively located on one side of a central axis of the vortex tube right part (6): the first sliding rod (9) and the third sliding rod (11) are located at an upper portion of the vortex tube right part (6), and the second sliding rod (10) is located at a lower portion of the vortex tube right part (6); an air inlet, a first connection hole (16), a second connection hole (17) and a third connection hole (15) are provided on a wall of the vortex tube left part (2); the air inlet on the wall of the vortex tube left part (2) corresponds to the air inlet on the wall of the vortex tube right part (6), the first sliding rod (9) is movably inserted in the first connection hole (16), the second sliding rod (10) is movably inserted in the second connection hole (17), and the third slide rod (11) is movably inserted in the third connection hole (15).

2. A method of applying a half-slide matched device for ultra-smoothly reconstructing yarn hairy structure on a textile machine, comprising steps of: at least fixedly engaging a vortex device static part of a first half-slide matched device with a vortex tube right part (6) of a second half-slide matched device by a fixer (7), and fixedly engaging a vortex device moving part of the first half-slide matched device with a vortex tube left part (2) of the second half-slide matched device by a connector (1); fixedly connecting the connector (1) to an end of a push-pull rod (20), and externally connecting the other end of the push-pull rod (20) to a pneumatic device.

3. The method, as recited in claim 2, wherein the textile machine is a ring spinning frame, a rotor spinning machine, a winder, a warping machine, a weft knitting machine, a warp knitting machine or an air jet loom.

* * * * *